US005175928A

United States Patent [19]

Grabbe

[11] Patent Number: 5,175,928

[45] Date of Patent: Jan. 5, 1993

[54] METHOD OF MANUFACTURING AN ELECTRICAL CONNECTION ASSEMBLY

[75] Inventor: Dimitry G. Grabbe, Middletown, Pa.

[73] Assignee: AMP Incorporated, Harrisburg, Pa.

[21] Appl. No.: 758,221

[22] Filed: Sep. 5, 1991

Related U.S. Application Data

[63] Continuation of Ser. No. 536,149, Jun. 8, 1990, abandoned.

[51] Int. Cl.[5] ..... H01R 43/16

[52] U.S. Cl. ..... 29/884; 29/885; 439/885; 439/886

[58] Field of Search ..... 29/883, 884, 885; 439/885, 886

[56] References Cited

U.S. PATENT DOCUMENTS

| | | | |
|---|---|---|---|
| Re. 32,691 | 6/1988 | Dola et al. | 439/608 |
| 3,252,206 | 5/1966 | Stevens | 29/883 X |
| 3,744,128 | 7/1973 | Fisher et al. | 439/88 |
| 4,241,976 | 12/1980 | Oliver et al. | 29/883 X |
| 4,360,245 | 11/1982 | Nikitas | 439/578 |
| 4,846,727 | 7/1989 | Glover et al. | 439/608 |
| 4,861,271 | 8/1989 | Bogar et al. | 439/63 |
| 4,906,194 | 4/1989 | Grabbe | 439/71 |
| 4,931,754 | 6/1990 | Moussie | 439/620 |
| 4,981,451 | 1/1991 | Undin et al. | 439/885 |
| 5,018,985 | 5/1991 | Moore | 29/884 X |

FOREIGN PATENT DOCUMENTS

| | | | |
|---|---|---|---|
| 0005983 | 12/1979 | European Pat. Off. | 439/693 |
| 1971197 | 5/1971 | Japan | 439/608 |

*Primary Examiner*—Carl J. Arbes

*Attorney, Agent, or Firm*—James M. Trygg; Bruce J. Wolstoncroft

[57] ABSTRACT

An electrical connector assembly having a metal or metallized plastic housing block (10) with contact members (26) contained within channels (12) in the block (10). The metallic housing block (10) provides a shield to eliminate cross-talk between the contact members (26). The contact members (26) are directly coated with a dielectric material, except where they perform an electrical contact function, to insulate them from the metallic housing block (10).

12 Claims, 4 Drawing Sheets

METHOD OF MANUFACTURING AN ELECTRICAL CONNECTION ASSEMBLY

This application is a Continuation of application Ser. No. 07/536,149 filed Jun. 8, 1990, now abandoned.

BACKGROUND OF THE INVENTION

This invention relates to electrical connector assemblies and, more particularly, to electrical connector assemblies of densely packed contact members capable of passing fast rise time pulses without cross-talk between adjacent contact members.

There presently exists in the marketplace a large family of electrical connectors which have a thick plastic housing and long channels, or holes, into which either male or female contact members are inserted. These connectors are typically utilized for mounting and connecting daughter printed circuit boards onto mother printed circuit boards and represent a major multi-million dollar investment in tooling for the housings, the contact members and the assembly machinery. In general, when signals passed by the connector assembly have two nanosecond or slower rise times, these connector assemblies have proven to provide satisfactory performance. However, the industry is moving to much faster rise times and, with the shortening of the rise times this tends to increase the cross-talk between adjacent contact members. In the past, to eliminate such cross-talk, signal-carrying contact members have been surrounded by between four and eight grounded contact members which act as a shield. A major problem with this approach is that as the complexity of the electronics mounted to the printed circuit board increases, there is insufficient room for the extra grounded contact members. Accordingly, it is an object of the present invention to provide an electrical connector assembly which eliminates cross-talk between signal-carrying contact members without the use of grounded shielding contact members.

One approach to solving this problem is detailed in my U.S. Pat. No. 4,906,194, where I disclose a high density connector assembly for an integrated circuit chip carrier which includes a stack of metallic plates having apertures which form chambers for holding contact members therein. The stack of plates provides a ground shield around each of the contact members to prevent cross-talk therebetween. To insulate the plates from the contact members, the plates are coated with an insulating layer of dielectric material. This method of constructing a connector housing block, while suitable for relatively thin connectors of the type disclosed in the referenced patent, is economically prohibitive for larger circuit board to circuit board connectors which frequently have a thickness greater than one-half inch.

It is therefore a further object of the present invention to provide a larger size connector assembly which provides cross-talk shielding and which salvages as much as possible the tooling, assembly machines, etc., which already exist for the present connector assembly which it replaces.

SUMMARY OF THE INVENTION

The foregoing and additional objects are attained in accordance with the principles of this invention by providing an electrical connector assembly including a plurality of metal contact members each of which has a first contact portion, a second contact portion, and a body portion, a metal or metallized plastic housing having a plurality of channels each adapted to contain therein at least the body portion of a respective one of the plurality of contact members, and means separate from the housing for insulating each of the contact members from the metal housing.

In accordance with an aspect of this invention, the insulating means comprises a coating of dielectric material on the body portion of each of the contact members.

BRIEF DESCRIPTION OF THE DRAWINGS

The foregoing will be more readily apparent upon reading the following description in conjunction with the drawings in which like elements in different figures thereof have the same reference numeral and wherein.

DETAILED DESCRIPTION

Figure 1:
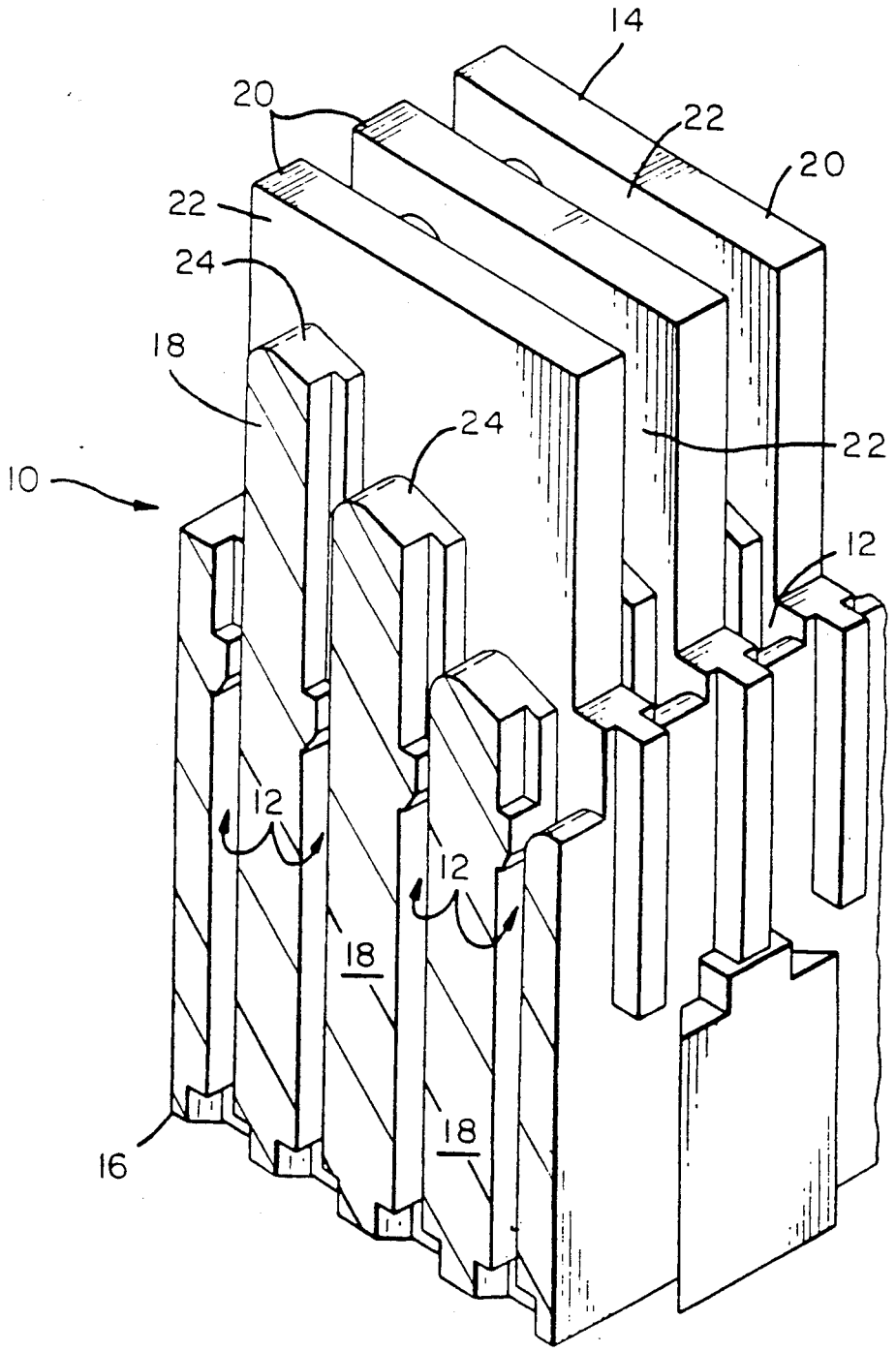
FIG. 1 is a sectioned perspective view of the housing of an electrical connector assembly to which the principles of this invention may be applied.

An illustrative connector housing block of the type with which the present invention is concerned is illustrated in FIG. 1. As shown therein, the connector housing block 10 has a plurality of channels, or passages, 12 extending through the block 10 and opening out onto surfaces 14, 16. The channels 12 are arranged in an array of rows and columns, with the rows of channels 12 being separated by interior longitudinal walls 18 and the columns of channels 12 being separated by transverse walls 20. The channels 12 open out into slots 22 which are defined by adjacent transverse walls 20 and free ends 24 of longitudinal walls 18.

According to the present invention, the connector housing block 10 is either formed of metal, such as for example, by an aluminum or zinc die casting process, or alternatively the housing block 10 is formed of plastic which is subsequently metallized. It is preferable to use a metallized plastic housing if the tooling for the housing already exists. The metallic connector housing block 10 then inherently provides a ground shield around each of the contact members in a channel 12, which allows a high density of contact members without cross-talk therebetween.

However, since the contact members are themselves made of metal, some means must be provided for insulating the contact members from the metallic connector housing block 10. There are several ways of surrounding each of the contact members with an insulating dielectric. One way is to plate the dielectric directly on the interior walls of the channels 12. This poses a problem since all of the available plating methods, such as dipping, electrostatically spraying and fusing powders, spray painting, or electrophoretic deposition, are unable to produce a uniform thickness of deposition of dielectric at the mouths and at the centers of the channels 12. (It is to be noted however that a uniform thickness of metal can be obtained by an electroless process to form a metallized plastic housing.) A second way of providing insulation is to insert a prefabricated dielectric sleeve into each of the channels 12, the contact members then being inserted within the sleeve. This can be a viable approach for those cases where there is sufficient room available to do so, since such a sleeve would have to be of sufficient mechanical strength, and therefore bulk, to withstand handling and insertion into the housing.

In accordance with the principles of this invention, a third approach is proposed. This inventive approach is to have an existing contact member, as presently used in an existing connector housing block, coated directly with a dielectric material. The portions of the contact member which perform the mechanical function, such as a structural member or a spring, can be coated on all surfaces. The portions of the contact member which perform electrical contacting functions must remain free of any dielectric material.

Figure 2A:
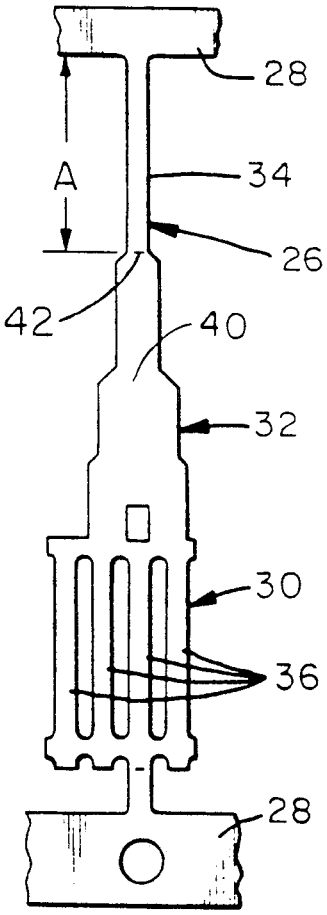
FIGS. 2A–2D illustrate various steps in the formation of an illustrative contact member for use with the housing of FIG. 1.
Figure 2B:
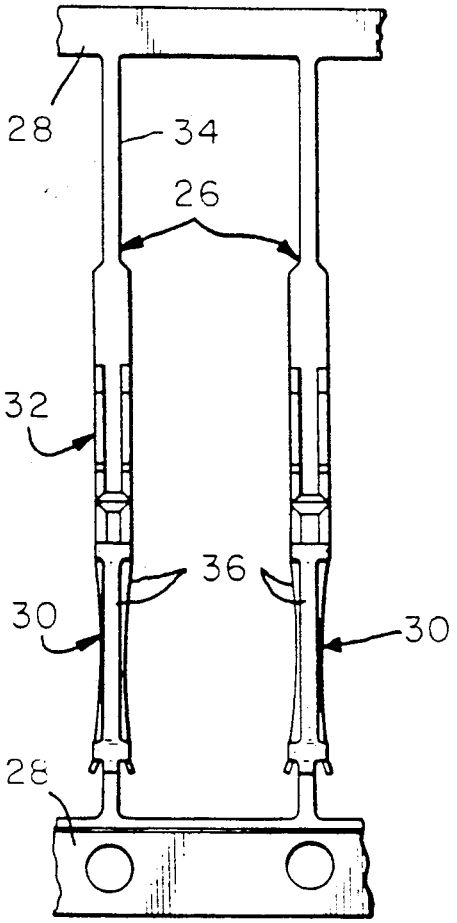
Figure 2C:
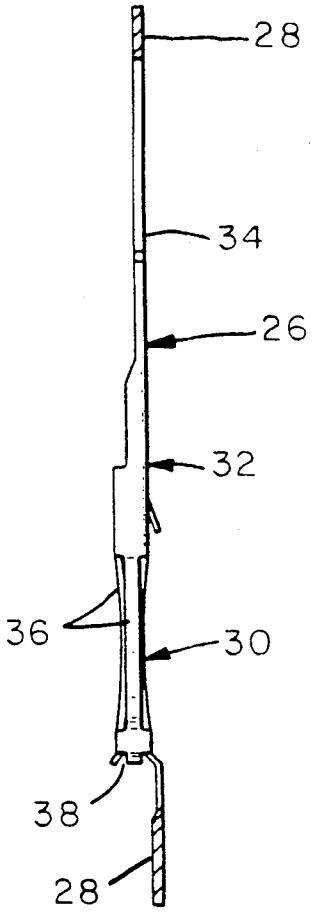
Figure 2D:
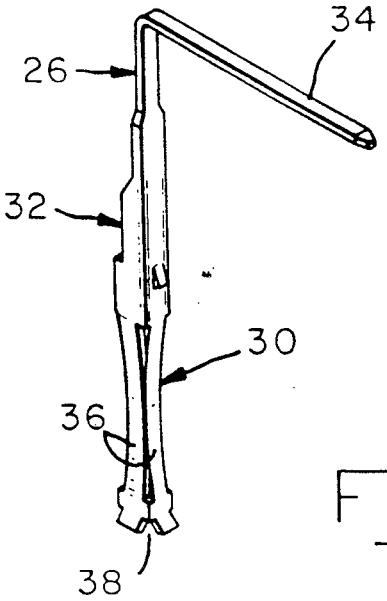
Figure 3:
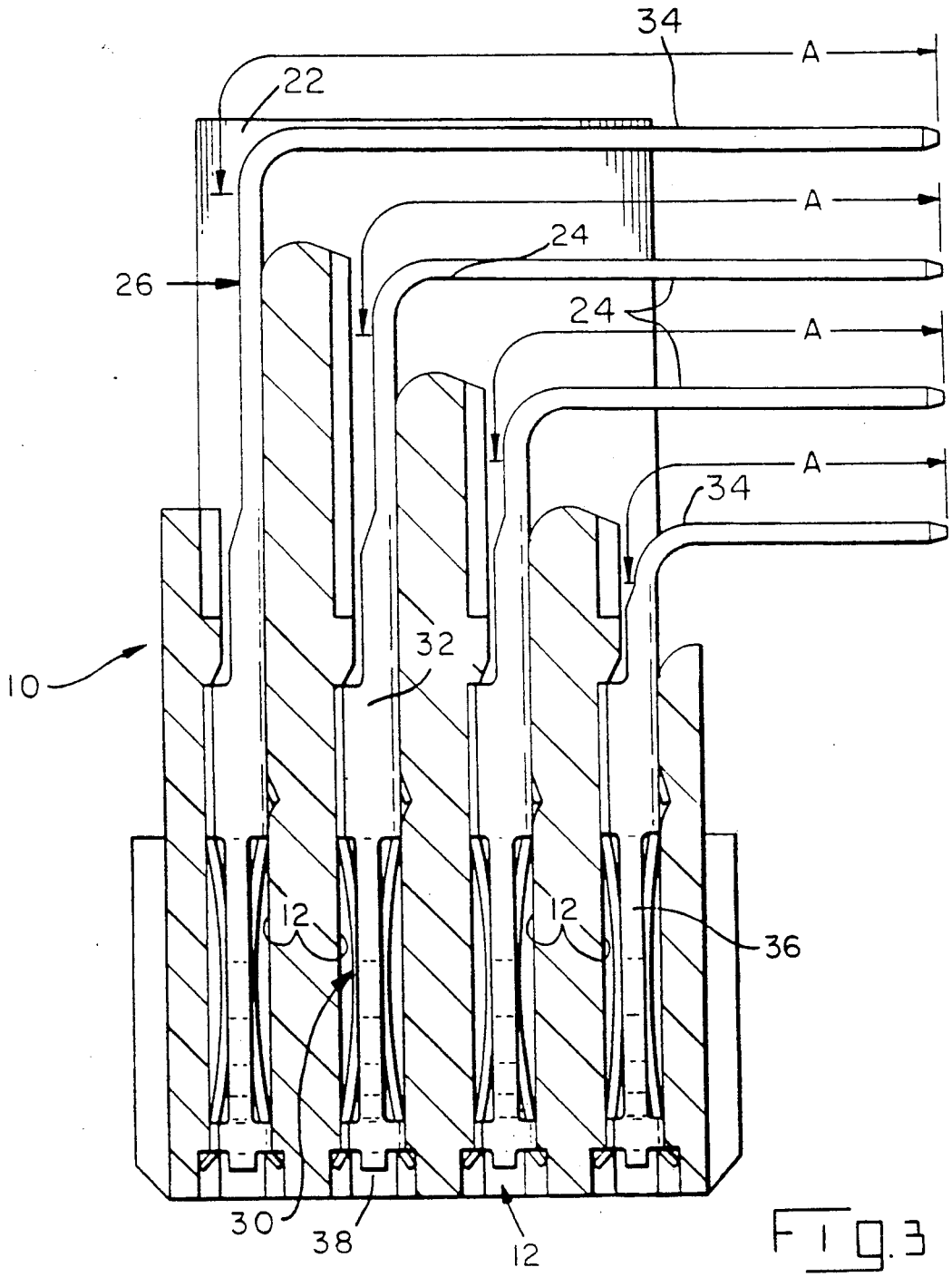
FIG. 3 is sectional view of the housing of FIG. 1 having installed therein a plurality of the contact members of FIGS. 2A–2D.

FIGS. 2A-2D illustrate steps in the formation of a contact member 26 for use with the connector housing block 10 of FIG. 1, and FIG. 3 illustrates the installation of the contact members 26 in the channels 12 of the block 10. It is to be noted that each of the contact members 26 has a male contact portion and a female contact portion, but the principles of this invention may be applied to any other type contact member such as one with two male contact portions or one with two female contact portions.

Typically, contact members for electrical connector assemblies are manufactured by stamping and forming from flat metal sheet stock. FIG. 2A shows the contact member 26 after being stamped but prior to being formed, while still being attached to parallel carrier strips 28, as is conventional in the art. FIG. 2B shows the contact members 26 still attached to the carrier strips 28 but after being formed, with FIG. 2C being an end view of FIG. 2B. FIG. 2D shows the completed contact member 26 after removal from the carrier strips 28 and after it has assumed its final form upon installation in the block 10.

Thus, the illustrative contact member 26 includes female receptacle portion 30, intermediate body portion 32 and male contact portion 34. The female receptacle portion 30 includes four resilient beams 36 defining a post receiving space 38 therebetween. As is clear from FIG. 3, the contact members 26 are formed with different lengths for the male contact portion 34 to accommodate the location and length of the channels 12 in the block 10. In all other respects, each contact member 26 is identical to another contact member 26.

As is clear from FIG. 3, when each of the contact members 26 is coated with an insulative dielectric material, the distal end of the male contact portion 34, extending a distance "A" from the end, should be free of the dielectric coating so that it can perform its electrical contact function. This end of the contact member 26 does not touch the block 10. Similarly, the portions of the resilient beams 36 which form the interior walls of the post receiving space 38 must be free of the dielectric coating so that they too may perform their electrical contact function. The body portion 32 of the contact member 26, the remainder of the male contact portion 34, and the exteriorly facing portions of the resilient beams 36 should all have the dielectric coating thereon because they may be in contact with the metal of the block 10.

Application of the dielectric material can be accomplished in a number of different ways such as, for example, by spraying, dipping, electrostatic powder deposition and fusing, and electrophoretic deposition. Each of these processes permits a selection of materials with different dielectric properties. For example, spraying with a combination of polytetrafluoroethylene (such as teflon) with a small amount of polyimid produces a coating with very low dielectric constant. On the other hand, electrophoretic deposition using a material such as, for example, aluminum oxide or barium titanate produces a coating with very high dielectric constant. The choice of material or process to use may be governed more by the required impedance considerations, given a set of available dimensions, than any other considerations. Other processes for coating the contact member 26 include sputtering and ion beam deposition, which may not be economically feasible.

Since a typical preferred dielectric material, such as aluminum oxide, is relatively hard, if it were applied to the contact members 26 while they are in the form shown in FIG. 2A continued formation of the contact members as shown in FIGS. 2B and 2C would result in the dielectric material breaking at the fold points and subsequently flaking off the contact members 26. It is therefore preferred that when the contact members are in the form shown in FIGS. 2B and 2C, that they be held by the upper carrier strip 28 and dipped into a dielectric-carrying solution for deposition, such as by an electrophoretic process. This dipping should be to the point 42 (FIG. 2A) so that the distal end of the male contact portion 34, extending the distance "A" from the extremity, is free of the dielectric coating. As shown in FIG. 3, the distance "A" along the male contact portion 34 is of sufficient length that it passes the bend point of the portion 34 but stops short of where the contact member 26 touches a metallic wall of the housing block 10. Thus, all bending which occurs after the dielectric coating is applied takes place in a region which is free of the dielectric coating so that no flaking occurs. Since it is desired that the dielectric coating not cover the portions of the resilient beams 36 which form the interior walls of the post receiving space 38, prior to the dipping a plastic pin is inserted into the post receiving space 38 of each of the contact members 26. Since the dielectric coating will be applied to all areas of the post receiving space 38 which are not in physical contact with the plastic pin, it is preferred that the plastic of the pin be soft enough that it deforms slightly so as to conform as much as possible to the walls formed by the resilient beams 36.

The aforedescribed invention possesses a number of advantages. Thus, by forming the connector housing block of metal or metallized plastic, a shield around each of the contact members is inherently provided, thereby eliminating the cross-talk between contact members. Also, forming the connector housing block and the contact members without change from a prior configuration results in use of the same tooling and assembling machinery, thereby avoiding unnecessary additional expense. Further, adding the insulation directly to the contact members results in minimal incremental cost.

Accordingly, there has been disclosed an improved electrical connector assembly of densely packed contact members capable of passing fast rise time pulses without cross-talk between adjacent contact members. While an illustrative embodiment has been disclosed, it will be apparent to those skilled in the art that various modifications to that embodiment may be made and it is only intended that the scope of this invention be limited by the appended claims.

I claim:

1. A method of manufacturing an electrical connector assembly, comprising the steps of:

providing a metallic housing having a plurality of channels opening onto a first surface and a second surface of said housing;

providing a plurality of metal contact members adapted for containment each within a respective one of said housing channels, each of said contact members having a first contact portion, a second contact portion and a body portion, said first and second contact portion of each of said contact members being exposed at said housing first and second surfaces, respectively, when said each contact member is contained within the respective housing channel, the step of providing a plurality of metal contact members including stamping and forming from sheet stock said plurality of metal contact members attached to a carrier strip;

depositing on at least the body portion of said each contact member while attached to said carrier strip a layer of dielectric material so as to insulate said each contact member from said housing;

removing said plurality of contact members from said carrier strip; and installing said plurality of contact members in the respective housing channels.

2. The method according to claim 1 wherein the step of depositing includes the step of dipping said plurality of contact members into a dielectric-carrying solution.

3. The method according to claim 1 wherein the step of depositing includes an electrophoretic process.

4. The method according to claim 1 wherein the step of depositing includes the step of spraying said plurality of contact members.

5. The method according to claim 1 wherein the step of depositing includes a process of electrostatic powder deposition and fusing.

6. The method according to claim 1 wherein the step of depositing includes the step of spraying said plurality of contact members with a mixture of polytetrafluoroethylene with polyimid.

7. The method according to claim 1 wherein the step of depositing includes the step of electrophoretic deposition with aluminum oxide.

8. The method according to claim 1 wherein the step of depositing includes the step of electrophoretic deposition with barium titanate.

9. The method according to claim 1 wherein the step of depositing includes the step of sputtering.

10. The method according to claim 1 wherein the step of depositing includes the step of ion beam deposition.

11. The method according to claim 6 wherein said first contact portion is a female receptacle portion and further including the step of:

inserting a deformable member in said female receptacle portion prior to the step of depositing, said deformable member conforming to the interior walls of said female receptacle portion so that said dielectric material is not subsequently deposited on said walls.

12. The method according to claim 1 further including the step of bending said each contact member after the step of depositing and wherein the step of depositing avoids placing said layer of dielectric material on any part of said each contact member which is subsequently bent.

* * * * *